US008807105B2

(12) United States Patent
Kim et al.

(10) Patent No.: US 8,807,105 B2
(45) Date of Patent: Aug. 19, 2014

(54) CAM FOLLOWER WITH IMPROVED STRUCTURE TO INCREASE LIMIT LOAD

(75) Inventors: Sung Gi Kim, Seoul (KR); Keun Chul Song, Seoul (KR)

(73) Assignee: Doosan Infracore Co., Ltd., Incheon (KR)

( * ) Notice: Subject to any disclaimer, the term of this patent is extended or adjusted under 35 U.S.C. 154(b) by 29 days.

(21) Appl. No.: 13/517,178

(22) PCT Filed: Dec. 20, 2010

(86) PCT No.: PCT/KR2010/009109

§ 371 (c)(1),
(2), (4) Date: Aug. 28, 2012

(87) PCT Pub. No.: WO2011/078533

PCT Pub. Date: Jun. 30, 2011

(65) Prior Publication Data

US 2012/0312265 A1 Dec. 13, 2012

(30) Foreign Application Priority Data

Dec. 21, 2009 (KR) ..... 10-2009-0128014
Dec. 22, 2009 (KR) ..... 10-2009-0128559

(51) Int. Cl.
*F01L 1/14* (2006.01)

(52) U.S. Cl.
USPC ..... 123/90.48; 123/90.39

(58) Field of Classification Search
USPC ..... 123/90.16, 90.48, 90.52, 90.39; 74/559, 74/569
See application file for complete search history.

(56) References Cited

U.S. PATENT DOCUMENTS 2,823,655 A 2/1958 Repko
5,954,020 A 9/1999 Schmidt et al.

FOREIGN PATENT DOCUMENTS

JP 07-332034 12/1995

OTHER PUBLICATIONS

Search Report dated Sep. 5, 2011, written in Korean for International Application No. PCT/KR2010/009109, filed Dec. 20, 2010, 3 pages.

*Primary Examiner* — Zelalem Eshete
(74) *Attorney, Agent, or Firm* — John D. Veldhuis-Kroeze; Westman, Champlin & Koehler, P.A.

(57) ABSTRACT

Disclosed is a cam follower of which the structure is improved such that the limit load can be increased. The cam follower is one which moves relative to a cam, mediated by a liquid lubricant, wherein a plurality of recesses are provided on the contact surface of the cam follower which makes contact with the cam, and the depth of the plurality of recesses of the contact surface is between 0.005 and 0.03 mm. By providing the plurality of recesses on the contact surface of the cam follower which makes contact with the cam, the present invention makes it possible to improve the state of lubrication between the cam follower and the cam which move relative to each other mediated by the liquid lubricant and to reduce the heat and the wear which occur at the interface between the same.

4 Claims, 5 Drawing Sheets

CAM FOLLOWER WITH IMPROVED STRUCTURE TO INCREASE LIMIT LOAD

This application is a Section 371 National Stage application of International Application No. PCT/KR2010/009109, filed Dec. 20, 2010 and published, not in English, as WO2011/078533 on Jun. 30, 2011.

FIELD OF THE DISCLOSURE

The present disclosure relates to a structure for improving limit load of a cam and a cam follower, particularly a cam follower with an improved structure to increase limit load of a cam and a cam follower by improving a lubrication property of the cam and the cam follower which make relative motion through a liquid lubricant.

BACKGROUND OF THE DISCLOSURE

In general, in an engine, a camshaft is rotated by torque of a crankshaft, external air is supplied into the combustion chamber by an intake valve and a fuel gas is injected into the combustion chamber while the intake and exhaust valves are reciprocated up/down at regular time interval by cams formed on the camshaft, a combustion gas is discharged by the exhaust valve by compressing and exploding a gas mixture, and a process of obtaining power from the explosive pressure is repeated.

FIG. 1 is a schematic cross-sectional view showing a valve train of a common vehicle.

A unit including a series of components such as a camshaft, a cam, a cam follower (or valve tappet), a push rod, a rocker arm, a valve spring, and a valve in order to operate intake and exhaust valves, as described above, is called a valve train.

FIG. 1 shows a valve train according to the related art, in which a plurality of cams 2 are formed at regular intervals along the axial line on a camshaft 1 and a cam follower 5 is disposed at the lower end of a push rod 4 that can slide up/down in an engine body block 3.

Further, the upper end of the push rod 4 is pivotably connected to a side of the rocker arm 6 and the upper end of the a valve 9 provided at an intake port or an exhaust port of a cylinder head block 7 and elastically supported by a valve spring 8 is pivotably connected to the other side of the locker arm 6.

The cam 2 of the camshaft 1 and the cam follower 5 of the push rod 4, which make a relative motion through the liquid lubricant while supporting load, have a small area at the friction portion in line contact with each other, such that large friction is generated under very high surface pressure between the cam 2 and the cam follower 5.

Therefore, in general, the two solid surfaces are not easily and completely separated only by the oil layer pressure of the lubricant, such that they are operated under composite lubrication including contact and lubrication or interface lubrication forming a surface layer through contact and lubrication. In general, the friction property is not good and a large amount of heat and wear is generated under the composite friction or the interface lubrication, and when a vehicle travels for a long time under those operating conditions, the lubrication surfaces of the cam 2 and the cam follower 5 may be damaged.

Meanwhile, it has been well known from a liquid lubrication theory that when the two surfaces are parallel, fluid dynamic pressure is not generated in lubrication even if the two surfaces make relative motion through the liquid lubricant. Though there is an exception, the fluid dynamic pressure is usually generated when a wedge effect reducing the thickness of an oil layer in the sliding direction. For example, in a dynamic pressure thrust bearing and a journal bearing, the thrust bearing and the journal bearing generate the wedge effect through an assembly error and eccentricity, respectively.

However, common workpieces have fine curves or surface curves due to surface roughness. Even if two surfaces relatively move in parallel with each other, there are areas where oil layer thickness locally reduces in the sliding direction and the oil layer pressure generated in the areas improve lubrication performance between the two surfaces. On the contrary, there are also areas where the oil layer thickness increases in the sliding direction, where bubbles are usually generated in the areas and pressure similar to the peripheral pressure is generated.

Therefore, when a plurality of fine prominences and depressions is formed on at least one of two surfaces making relative motion, fluid dynamic pressure is generated between the two surfaces and the lubrication performance can be correspondingly improved, even if the two surfaces relatively move in parallel with each other. Further, it has been known that the fine prominences and depressions catch worn particles or function as fine oil storage, such that the technology has been studied in various fields due to the effects.

The point of the technology of reducing friction and wear due to fine prominences and depressions on a surface is to determine the shape of the prominences and depressions and the arranging method such that friction and wear become minimized. However, since the shape of the prominences and depressions and the arranging method are greatly influenced by the operating conditions such as the contact type of two surfaces, load, and sliding speed, there is large difficulty in developing the technology. For example, the shape of the prominences and depressions and the arranging method for minimizing friction and wear are changed in accordance with the type of the contact portion, that is, a line type, a point type, and a surface type. Therefore, it is necessary to define first the operation environment or the operating conditions in order to develop the technology of surface prominence and depression for reducing friction and wear, and it is necessary to develop the shape of the prominences and depressions and the arrangement under the determined operation environment and the operating conditions.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

Accordingly, one aspect of the present disclosure has been made in an effort to solve the problems described above.

In general, a cam and a cam follower, which make a relative motion through the liquid lubricant while supporting load, have a small area at the friction portion in line contact with each other, such that large friction is generated under very high surface pressure between the cam and the cam follower. Therefore, in general, the two solid surfaces are not easily and completely separated only by the oil layer pressure of the lubricant, such that they are operated under composite lubrication or interface lubrication. In general, the friction property is not good and a large amount of heat and wear is generated under the composite friction or the interface lubrication, and when a vehicle travels for a long time under those operating conditions, the lubrication surfaces of the cam and the cam follower may be damaged.

However, when prominences and depressions are formed on at least one of the cam or the cam follower, the liquid lubricant in the prominences and depressions improves the lubrication state and reduces heat and wear generated on the interface. Accordingly, it is possible to achieve an effect of improving limit load of the cam and the cam follower.

However, when too many prominences and depressions are formed and the area of the friction portion without the prominences and depressions is too small, the surface pressure of the friction portion increases and the friction property may be deteriorated. Further, when the shapes of the prominences and depressions are not appropriate, the improvement effect may be insufficient. For reference, the appropriate shapes of the prominences and depressions may depend on the load exerted between the cam and the cam follower or the viscosity of the lubricant.

Therefore, the present disclosure intends to propose a shape of prominence and depression which can considerably improve limit load of a friction surface between a cam and a cam follower when the cam and the cam follower, which make relative motion through a liquid lubricant, operate within a predetermined operating conditions.

Therefore, one aspect of the present disclosure is to improve the friction structure of a cam and a cam follower, which make relative motion through a liquid lubricant, to improve the lubrication state between the cam and the cam follower and reduce heat and wear generated on the interface.

Another aspect of the present disclosure is to provide a cam and a cam follower having an improve structure to increase limit load of a friction surface between the cam and the cam follower, which make relative motion through a liquid lubricant, when the cam and the cam follower operate within a predetermined operating condition.

In order to achieve the aspects of the disclosure, a cam follower moves relatively to a cam through a liquid lubricant, in which a plurality of grooves is formed on a contact surface of the cam follower being in contact with the am and the depths d of the plurality of grooves of the contact surface is 0.005 to 0.03 mm.

Further, the present disclosure further provides the following detailed exemplary embodiments for the exemplary embodiment of the present disclosure described above.

According to an exemplary embodiment of the present disclosure, the depths of the plurality of grooves of the contact surface are 0.01 to 0.03 mm.

According to an exemplary embodiment of the present disclosure, the contact surface includes a plurality of grooves forming a lattice pattern and the widths of the grooves are 0.05 to 0.25 mm.

According to an exemplary embodiment of the present disclosure, the contact surface includes a plurality of grooves forming a lattice pattern and the gaps of the grooves are 0.5 to 2.0 mm.

According to an exemplary embodiment of the present disclosure, the contact surface includes a plurality of grooves forming a lattice pattern and limit load per cam width is 30 kgf/mm or less under an operating condition in which viscosity of the liquid lubricant is 0.02 Pa·s or less.

According to an exemplary embodiment of the present disclosure, the contact surface includes a plurality of circular grooves and the diameters of the grooves are 0.05 to 0.15 mm.

According to an exemplary embodiment of the present disclosure, the contact surface includes a plurality of circular grooves and the gaps of the grooves are 00.25 to 0.50 mm.

According to an exemplary embodiment of the present disclosure, the cam follower is a tappet.

According to an exemplary embodiment of the present disclosure, the contact surface includes a plurality of circular grooves and limit load per cam width is 24.2 kgf/mm or less under an operating condition in which viscosity of the liquid lubricant is 0.02 Pa·s or less.

The present disclosure makes it possible to improve a lubrication state between a cam and a cam follower that make relative motion through a liquid lubricant, and to reduce heat and wear generated on the interface of them, by providing a plurality of grooves having a lattice pattern or a plurality of circular grooves on the contact surface of the cam follower being in contact with the cam.

Further, the present disclosure makes it possible to increase the limit load on the contact surface between the cam and the cam follower up to about 20 to 30% when the cam and the cam follower, which move relatively to each other through a liquid lubricant, within a predetermined operating condition, by providing a plurality of grooves having a lattice pattern or a plurality of circular grooves on the contact surface of the cam follower being in contact with the cam.

DETAILED DESCRIPTION

Hereinafter, a cam follower according to a first exemplary embodiment of the present disclosure will be described with reference to FIGS. 3 to 5.

Figure 1:
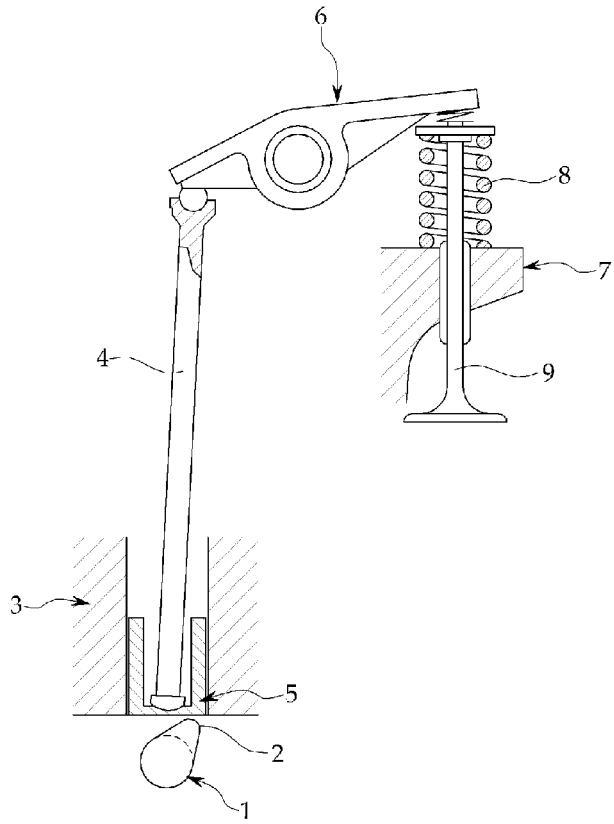
FIG. 1 is a schematic cross-sectional view showing a valve train of a common vehicle.
Figure 2:
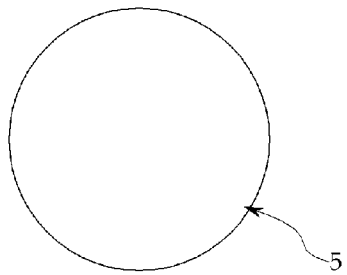
FIG. 2 is a schematic plan view of a cam follower according to the related art.
Figure 3:
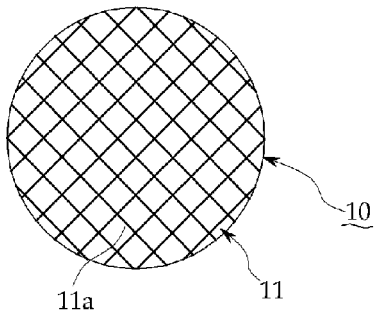
FIG. 3 is a schematic plan view of a cam follower having an improved structure on the contact surface with a cam according to a first exemplary embodiment of the present disclosure.
Figure 4:
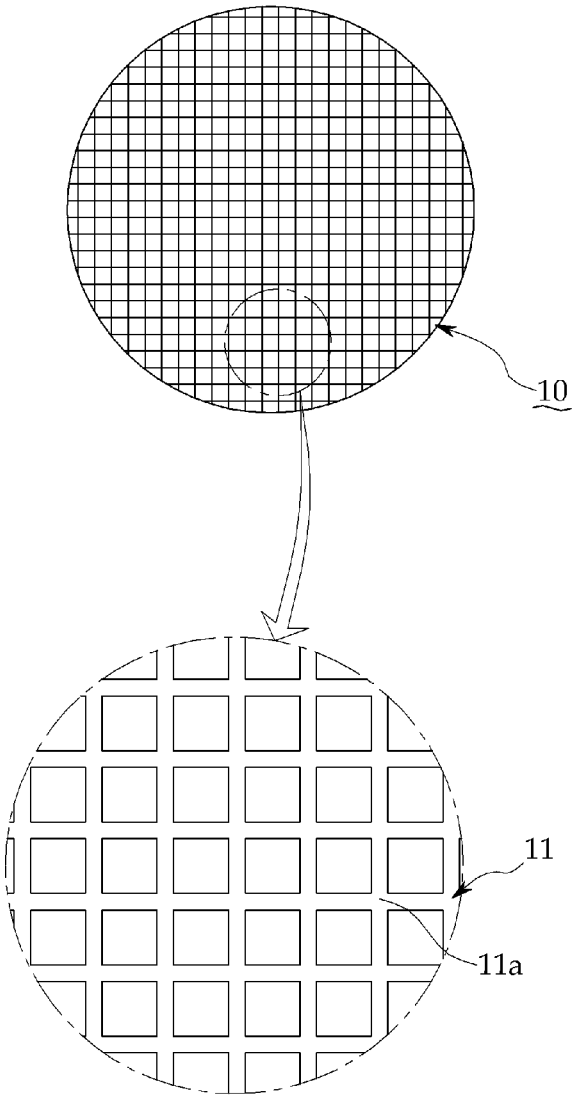
FIG. 4 is a picture showing a cam follower according to the first exemplary embodiment of the present disclosure.
Figure 5:
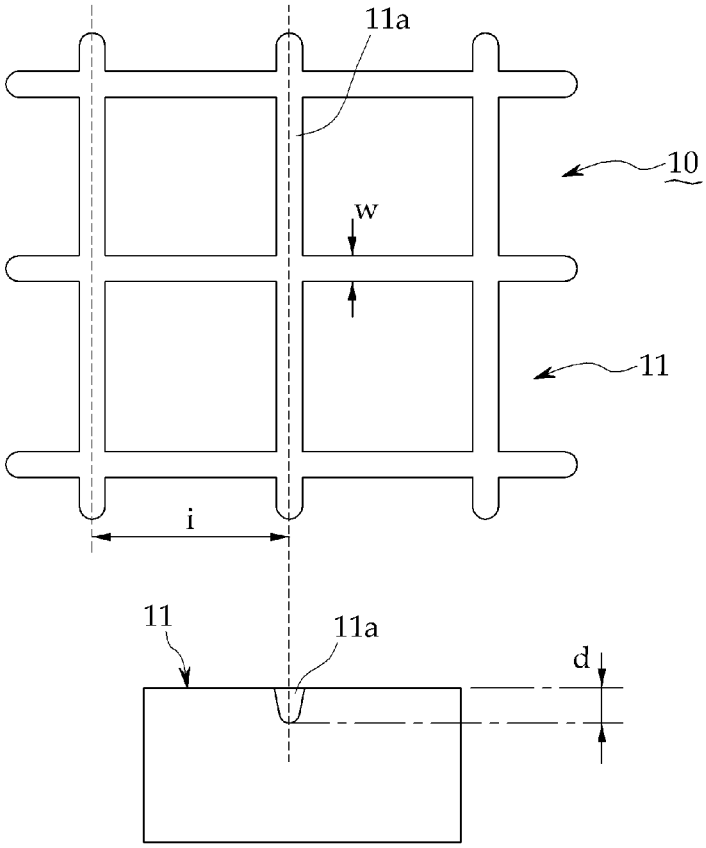
FIG. 5 is a view showing design variables of the cam follower according to the first exemplary embodiment of the present disclosure.

FIG. 3 is a schematic plan view of a cam follower having an improved structure on the contact surface with a cam according to a first exemplary embodiment of the present disclosure, FIG. 4 is a picture showing a cam follower according to the first exemplary embodiment of the present disclosure, and FIG. 5 is a view showing design variables of the cam follower according to the first exemplary embodiment of the present disclosure.

In general, a cam and a cam follower, which make a relative motion through the liquid lubricant while supporting load, have a small area at the friction portion in line contact with each other, such that large friction is generated under very high surface pressure between the cam and the cam follower. Therefore, in general, the two solid surfaces are not easily and completely separated only by the oil layer pressure of the lubricant, such that they are operated under composite lubrication or interface lubrication. In general, the friction property is not good and a large amount of heat a wear is generated under the composite friction or the interface lubrication, and when a vehicle travels for a long time under those operating conditions, the lubrication surfaces of the cam and the cam follower may be damaged.

However, when prominences and depressions are formed on at least one of the cam or the cam follower, the liquid lubricant in the prominences and depressions improves the lubrication state and reduces heat and wear generated on the interface. Accordingly, it is possible to achieve an effect of improving limit load of the cam and the cam follower.

However, when prominences and depressions are formed too much and the area of the friction portion without the prominences and depressions is too small, the surface pressure of the friction portion increases and the friction property may be deteriorated. Further, when the shapes of the prominences and depressions are not appropriate, the improvement effect may be insufficient. For reference, the appropriate shapes of the prominences and depressions may depend on the load exerted between the cam and the cam follower or the viscosity of the lubricant.

Therefore, the present disclosure intends to propose a shape of prominence and depression which can considerably improve limit load of a friction surface between a cam and a cam follower when the cam and the cam follower, which make relative motion through a liquid lubricant, operate within a predetermined operating conditions.

A structure for improving limit load of a cam and a cam follower according to the present disclosure is preferably implemented such that, as shown in FIGS. 3 and 4, a plurality of grooves 11*a* is formed on a contact surface 11 of a cam follower 10 being in contact with a cam and the depth of the grooves 11*a* of the contact surface 11 is 0.01 to 0.03 mm, in a cam and a cam follower which make a relative motion through the liquid lubricant while supporting load. The reason is because an oily layer pressure generation effect increases and the lubrication improvement effect is excellent, when the depth of the grooves 11*a* is 0.01 to 0.03 mm.

The contact surface 11 with the grooves 11*a* catches a lubricant and supplies the caught lubricant to a friction portion between the cam and the cam follower 10, such that it has an advantage of reducing friction and heat on the interface between the cam and the cam follower 10 and correspondingly increasing limit load.

Further, the structure for improving limit load of a cam and a cam follower according to the present disclosure may be further limited in the basic configuration to the following detailed exemplary embodiments.

First, in the structure for improving limit load of a cam and a cam follower according to the present disclosure, the grooves 11*a* formed in a lattice pattern have depths d, widths w, and gaps i, as shown in FIG. 5. The present disclosure has been made in effort to improve limit load on the friction surface between the cam (not shown) and the cam follower 10, using the grooves 11*a* formed in a lattice pattern.

For example, it is preferable that the widths of the grooves 11*a* are 0.05 to 0.25 mm. The reason is because an oily layer pressure generation effect increases and the lubrication improvement effect is excellent, when the widths of the grooves 11*a* are 0.05 to 0.25 mm.

For example, it is preferable that the gaps of the grooves 11*a* are 0.5 to 2.0 mm. The reason is because an oily layer pressure generation effect increases and the lubrication improvement effect is excellent, when the gaps of the grooves 11*a* are 0.5 to 2.0 mm.

For example, the contact surface 11 may be composed of a plurality of grooves 11*a* having various shapes such as lattice pattern.

For example, it is preferable that load per cam width is 30 kgf/mm or less under an operating condition in which viscosity of the liquid lubricant is 0.02 Pa·s or less. The reason I because the effect of the contact surface 11 was found when the weight per cam width is 30 kgf/mm or less and the viscosity of the liquid lubricant is 0.02 Pa·s or less. The weight per cam width is a value obtained by dividing the load applied between the cam and the cam follower 10 by a valve spring (not shown) by the cam width.

Embodiment

Next, the excellence of the contact surface 11 having a lattice pattern proposed by the present disclosure is described and a limit load test was performed, as shown in the following table, to optimize the contact surface 11 having a lattice pattern.

TABLE 1

| | Design factor | | | Test result | | | | | |
|---|---|---|---|---|---|---|---|---|---|
| Specimen Specimen | Width (μm) | Depth (μm) | Gap (μm) | 19.2 (kgf/mm) | 20.8 (kgf/mm) | 23.1 (kgf/mm) | 24.2 (kgf/mm) | 24.6 (kgf/mm) | 25.4 (kgf/mm) |
| H1 | 50 | 10 | 1000 | Pass | Pass | Pass | Fail | — | — |
| H2 | 100 | 10 | 1000 | Pass | Pass | Pass | Pass | Fail | — |
| H3 | 150 | 10 | 1000 | Pass | Pass | Pass | Pass | Pass | Fail |
| H4 | 50 | 20 | 1000 | Pass | Pass | Fail | — | — | — |
| H5 | 100 | 20 | 1000 | Pass | Pass | Pass | Fail | — | — |
| H6 | 150 | 20 | 1000 | Pass | Pass | Pass | Pass | Fail | — |
| H7 | 100 | 30 | 1000 | Pass | Pass | Fail | — | — | — |
| H8 | 100 | 40 | 1000 | Pass | Fail | — | — | — | — |
| H9 | 200 | 10 | 1000 | Pass | Pass | Pass | Pass | Fail | — |
| H10 | 250 | 10 | 1000 | Pass | Pass | Fail | — | — | — |
| H11 | 300 | 10 | 1000 | Pass | Fail | — | — | — | — |
| H12 | 150 | 10 | 500 | Pass | Pass | Pass | Pass | Fail | — |
| H13 | 150 | 10 | 2000 | Pass | Fail | — | — | — | — |
| H14 | 150 | 10 | 3000 | Pass | Fail | — | — | — | — |

TABLE 1-continued

| | Design factor | | | Test result | | | | | |
|---|---|---|---|---|---|---|---|---|---|
| Specimen Specimen | Width (μm) | Depth (μm) | Gap (μm) | 19.2 (kgf/mm) | 20.8 (kgf/mm) | 23.1 (kgf/mm) | 24.2 (kgf/mm) | 24.6 (kgf/mm) | 25.4 (kgf/mm) |
| Comparative Example1 | — | — | — | Pass | Fail | — | — | — | — |

As shown in FIGS. 3 to 5, the contact surface 11 having a lattice pattern, as described above, is defined by three design variables, that is, the width w, the depth d, and the gap i, and the test was performed while increasing load per line width of the cam (not shown). The weight per cam width is a value obtained by dividing the load applied between the cam and the cam follower 10 by a valve spring (not shown) by the cam width. The revolution speed is 900 to 1200 rpm and they were rotated by 1,600,000 cycles. In the table, 'Fail' means when severe wear was generated during the rotations of 1,600,000 cycles and 'Pass' means when a small amount of wear was uniformly generated.

It can be seen from the test result that the limit load on the friction surface between the cam and the cam follower 10 is improved by forming the contact surface 11 having a lattice pattern. Further, it can be seen that the limit load is the highest in H3 and the lubrication property of the friction portion is the best. H3 is when the width is 0.15 mm and the depth is 0.01 mm in a groove. It is shown that the effect of the contact surface 11 having a lattice pattern is large when the groove width is 0.1 mm or more and the depth is 0.02 mm or less. Since the contact surface 11 having a lattice pattern designed by the present disclosure can improve the limit load up to about 30% in accordance with the shape, it is very important to minimize the friction coefficient by optimizing the shape.

Meanwhile, the cam followers according to the second and third exemplary embodiments of the present disclosure will be described with reference to FIGS. 6 to 10.

Figure 6:
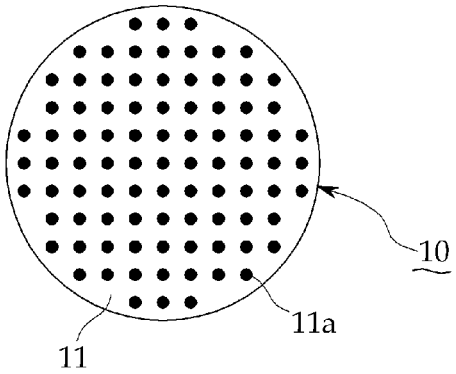
FIG. 6 is a schematic plan view of a cam follower having an improved structure on the contact surface with a cam according to a second exemplary embodiment of the present disclosure.
Figure 7:
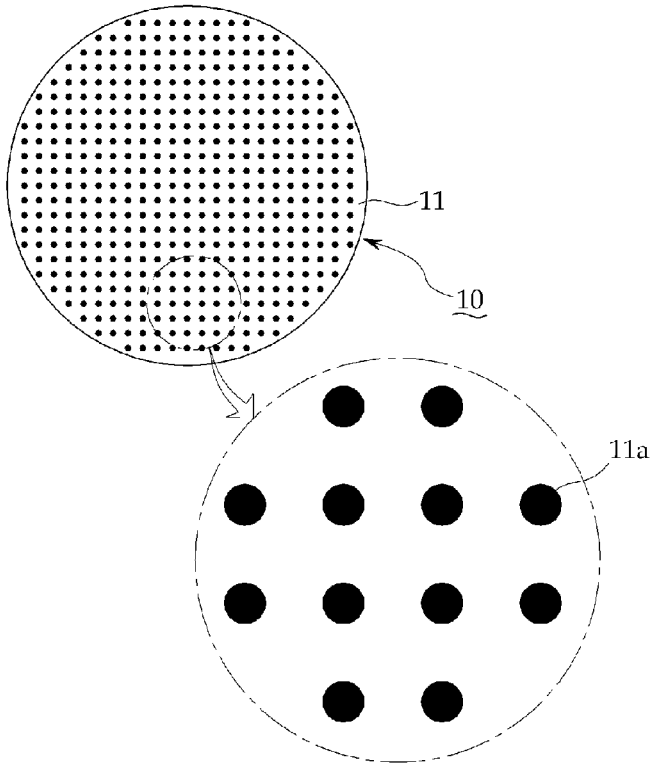
FIG. 7 is a picture showing a cam follower according to the second exemplary embodiment of the present disclosure.
Figure 8:
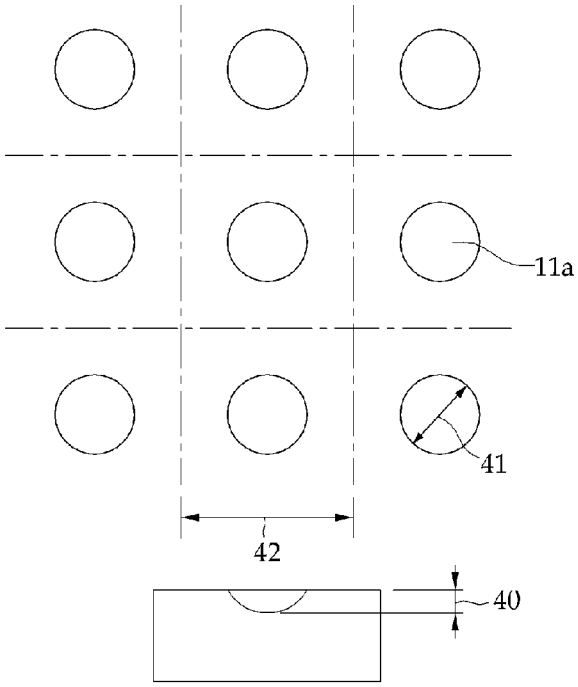
FIG. 8 is a view showing design variables of the cam follower according to the second exemplary embodiment of the present disclosure.

FIG. 6 is a schematic plan view of a cam follower having an improved structure on the contact surface with a cam according to a second exemplary embodiment of the present disclosure, FIG. 7 is a picture showing a cam follower according to the second exemplary embodiment of the present disclosure, FIG. 8 is a view showing design variables of the cam follower according to the second exemplary embodiment of the present disclosure.

The structure for improving limit load of a cam and a cam follower according to the present disclosure can be obtained by improving the structure of the contact surface between a cam and a cam follower, as shown in FIGS. 6 to 8.

As shown in FIGS. 7 and 8, in a cam follower moving relatively to a cam through a liquid lubricant, a plurality of fine circular grooves 11*a* is formed on the contact surface 11 of the cam follower. The grooves 11*a* catch a lubricant and supply the lubricant to the friction portion between the cam (not shown) and the cam follower 10, such that it is possible to reduce friction and heat generated on the contact surface that is the interface between the cam and the cam follower 10.

Therefore, it has the advantage in increasing limit load applied to the cam and the cam follower. The effect of increasing the limit load was seen up to 24.2 kgf/mm of weight per cam width on the contact surface 11, when the viscosity of the liquid lubricant is 0.02 Pa·s or less.

That is, when the cam follower of FIGS. 6 and 7 is applied, the cam follower can smoothly operate until the weight per cam width is 24.2 kgf/mm in the contact surface 11 of the cam and the cam follower when the viscosity of the liquid lubricant is 0.02 Pa·s or less. Therefore, it is possible to set the limit load per cam width to 24.2 kgf/mm or less, under the operating condition in which the viscosity of the liquid lubricant is 0.02 Pa·s or less.

The weight per cam width is a value obtained by dividing the load applied between the cam and the cam follower 10 by the cam width.

Figure 9:
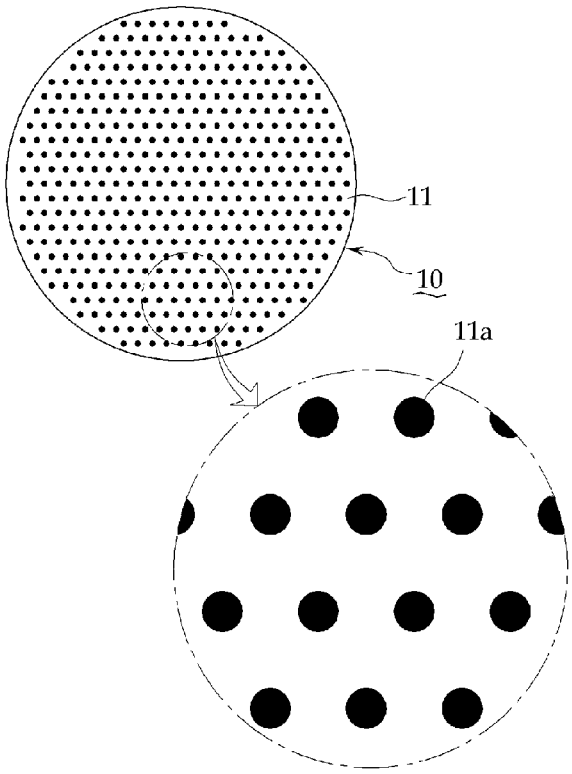
FIG. 9 is a picture showing a cam follower according to the third exemplary embodiment of the present disclosure.
Figure 10:
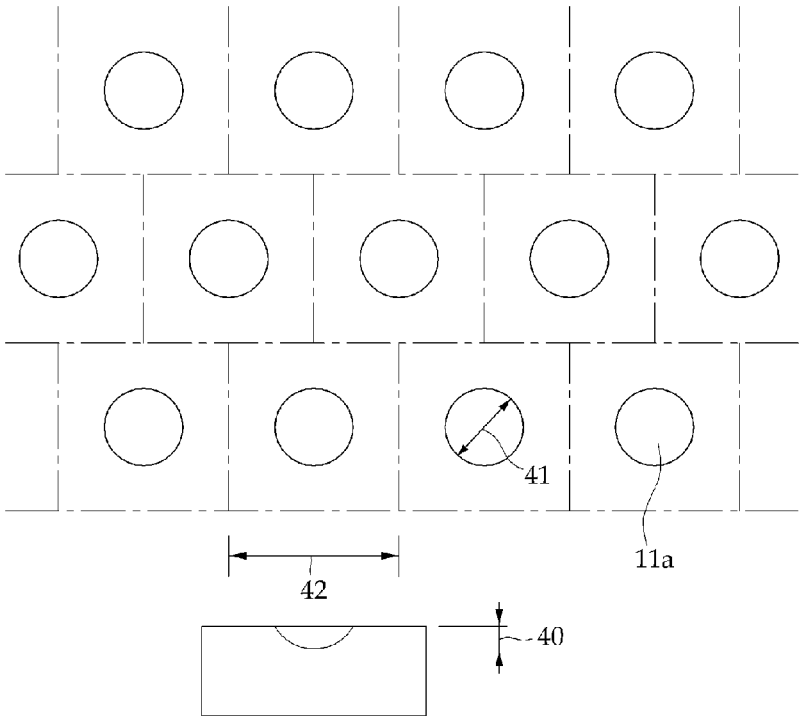
FIG. 10 is a view showing design variables of the cam follower according to the third exemplary embodiment of the present disclosure.

On the other hand, FIGS. 9 and 10 show a cam follower according to the third exemplary embodiment of the present disclosure. FIG. 9 is a picture showing a cam follower according to the third exemplary embodiment of the present disclosure and FIG. 10 is a view showing design variables of the cam follower according to the third exemplary embodiment of the present disclosure.

The method of forming the fine circular grooves 11*a* on the contact surface 11 of the cam follower 10 may be set by those skilled in the art, if necessary, other than the methods shown in the figures.

FIGS. 8 to 10 show the patterns of the circular grooves form on the cam follower according to the present disclosure.

The grooves are arranged by the depth 40, the diameter 41, and the gap 42, as shown in FIGS. 8 and 10.

In the present disclosure, the limit load on the friction surface is increased by appropriately matching the circular grooves 11*a* with the contact surface 11 of the cam follower 10.

According to an exemplary embodiment of the present disclosure, the depths 40 of the circular grooves 11*a* are determined within 0.02 mm. This is because the effect of generating oily layer pressure is increased and the lubrication improvement effect is excellent when the depths of the circular grooves 11*a* is less than 0.02 mm. Meanwhile, when the depths of the circular grooves 11*a* are too small, the circular grooves 11*a* cannot catch the lubricant, such that it is not meaningful to form the grooves. Therefore, according to an exemplary embodiment of the present disclosure, it is preferable that the depths 40 of the circular grooves 11*a* are 0.005 mm or more.

According to an exemplary embodiment of the present disclosure, the diameters 41 of the circular grooves 11*a* are set to be 0.05 mm or more. The reason is because an oily layer pressure generation effect increases and the lubrication improvement effect is excellent, when the diameters of the grooves 11*a* are above 0.05 mm. However, when the diameters of the circular grooves 11*a* are too large and the area of the friction area that is the area without the fine circular grooves 11*a* on the contact surface 11 of the cam follower 10 becomes too small, the surface pressure of the friction portion increases and the friction property may be deteriorated. Therefore, according to an exemplary embodiment of the present disclosure, it is preferable that the diameters 41 of the circular grooves 11*a* are 0.15 mm or less.

According to an exemplary embodiment of the present disclosure, the gaps 42 of the circular grooves 11*a* are set to be 0.25 mm or more. The reason is because an oily layer pressure generation effect increases and the lubrication improvement effect is excellent, when the gaps of the grooves 11*a* are above 0.25 mm. However, when the gaps between the circular grooves 11*a* is too large, the number of the fine circular grooves 11*a* formed on the cam follower 10 becomes too small, such that the capacity of catching a lubricant of the fine circular grooves 11*a* decreases and the lubrication property may be deteriorated. Therefore, according to an exemplary embodiment of the present disclosure, it is preferable that the gaps 41 between the circular grooves 11*a* are 0.50 mm or less.

According to an exemplary embodiment of the present disclosure, the depths 40 of the circular grooves 11*a* may be set within 0.02 mm and the diameters of the circular grooves 11*a* may be set above 0.05 mm.

According to an exemplary embodiment of the present disclosure, the diameters 41 of the circular grooves 11*a* may be set above 0.05 mm and the gaps 41 between the circular grooves 11*a* may be set above 0.25 mm.

According to an exemplary embodiment of the present disclosure, the depths 40 of the circular grooves 11*a* may be set within 0.02 mm and the gaps 41 between the circular grooves 11*a* may be set above 0.25 mm.

According to an exemplary embodiment of the present disclosure, the depths 40 of the circular grooves 11*a* may be set within 0.02 mm, the diameters 41 f the circular grooves 11*a* may be set above 0.05 mm, and the gaps 41 between the circular grooves 11*a* may be set above 0.25 mm.

A tappet that comes in contact with the cam in a valve train in a vehicle may be an example of the cam follower according to the present disclosure.

<Embodiments 1-8 and Comparative Examples 1-5>

The ability of supporting load of a cam follower with the fine circular grooves 11*a* according to the present disclosure was checked in Examples 1 to 8.

In detail, a tappet that operates in contact with the cam in a valve train in a vehicle was applied as a cam follower and fine circular grooves shown in FIG. 7 were formed on the surface of the tappet. The design variables when forming the fine circular grooves on the tappet, which is a cam follower, were given in Embodiments 1 to 8, as shown in Table 2. Tappets without fine circular grooves were given in Comparative Examples 1 to 5, for comparison.

Further, load test results on the cam followers (tappets) according to Embodiments 1 to 8 and Comparative Examples 1 to 5 are also shown in Table 2.

The fine circular grooves 11*a* were formed for three design variables, that is, different diameters 41, depths 40, and gaps 42, as described above.

The load tests were performed while increasing the load per line width of the cam (not shown). The weight per cam width is a value obtained by dividing the load applied between the cam and the cam follower by a valve spring (not shown) by the cam width.

The revolution speed is 900 to 1200 rpm and they were rotated by 1,600,000 cycles. In Table 2, 'Fail' means when severe wear was generated during the rotations of 1,600,000 cycles and 'Pass' means when a small amount of wear was uniformly generated.

According to the test result, it can be seen that the limit load on the friction surface between the cam and the cam follower is increased by forming the fine circular grooves 11*a*. In particular, it can be seen that the limit load was the highest in Embodiments of 4, 6, and 8, such that the lubrication property was considerably improved. According to the tests described above, when the diameters of the fine circular grooves 11*a* ire 0.05 mm or more, the depths are 0.02 mm or less, and the gaps are above 0.25 mm, the effect is large.

It can be seen that the fine circular grooves 11*a* according to the present disclosure can increase the limit load up to about 20% in accordance with the shape.

The cam follower according to the present disclosure can support up to the limit load per cam width of 24.2 kgf/mm under the operating condition in which the viscosity of the liquid lubricant is 0.02 Pa·s or less.

The present disclosure described above is not limited to the exemplary embodiment described above and the accompanying drawings and it is apparent to those skilled in the art that the present disclosure may be simply replaced, changed, and modified within the scope of the present disclosure.

The invention claimed is:

1. A cam follower that is configured to move relatively to a cam through a liquid lubricant comprising:

a contact surface that is formed on the cam follower being in contact with the cam; and a groove of lattice pattern that is formed uniformly on the contact surface, wherein depth of the groove of lattice pattern is 0.01 to 0.03 mm, and width of the groove of the grove of lattice

TABLE 2

| | Design variables | | | Test result | | | | |
|---|---|---|---|---|---|---|---|---|
| Item | Diameter (μm) | Depth (μm) | Gap (μm) | 19.2 (kgf/mm) | 20.8 (kgf/mm) | 23.1 (kgf/mm) | 24.2 (kgf/mm) | 25.5 (kgf/mm) |
| Embodiment 1 | 50 | 5 | 250 | Pass | Pass | Fail | — | — |
| Embodiment 2 | 50 | 5 | 400 | Pass | Pass | Fail | — | — |
| Embodiment 3 | 50 | 10 | 250 | Pass | Pass | Fail | — | — |
| Embodiment 4 | 50 | 10 | 400 | Pass | Pass | Pass | Fail | — |
| Embodiment 5 | 100 | 5 | 250 | Pass | Pass | Fail | — | — |
| Embodiment 6 | 100 | 5 | 400 | Pass | Pass | Pass | Fail | — |
| Embodiment 7 | 100 | 10 | 250 | Pass | Pass | Fail | — | — |
| Embodiment 8 | 100 | 10 | 400 | Pass | Pass | Pass | Pass | Fail |
| Comparative Example 1 | — | — | — | Pass | Fail | — | — | — |
| Comparative Example 2 | 20 | 2 | 200 | Pass | Fail | — | — | — |
| Comparative Example 3 | 30 | 3 | 300 | Pass | Fail | — | — | — |
| Comparative Example 4 | 200 | 25 | 550 | Pass | Fail | — | — | — |
| Comparative Example 5 | 250 | 30 | 600 | Pass | Fail | — | — | — |

pattern is 0.005 to 0.25 mm, and a gap between the groove of the groove of lattice pattern is 0.5 to 2.0 mm, wherein the cam follower is used such that limit load per cam width is 20.8 to 24.6 kgf/mm or less under an operating condition in which viscosity of the liquid lubricant is 0.02 Pa·s or less.

2. A cam follower that is configured to move relatively to a cam through a liquid lubricant, comprising:

a contact surface that is formed on the cam follower being in contact with the cam; and a plurality of circular grooves formed uniformly on the contact surface, wherein diameters of the circular grooves are 0.05 to 0.15 mm, and depth of the circular groves are 0.005 to 0.02 mm, and gaps between the grooves are 0.25 to 2.0 mm, wherein the cam follower is used such that limit load per cam width is 20.8 to 24.6 kgf/mm or less under an operating condition in which viscosity of the liquid lubricant is 0.02 Pa·s or less.

3. The cam follower of claim 2, wherein widths of the circular grooves are 0.005 to 0.03 mm.

4. The cam follower of claim 2, wherein the cam follower is a tappet.

* * * * *